US009511375B2

(12) United States Patent
Doppstadt et al.

(10) Patent No.: US 9,511,375 B2
(45) Date of Patent: Dec. 6, 2016

(54) BLADE CARRIER FOR COMMINUTION DEVICES

(75) Inventors: Johann Doppstadt, Velbert (DE); Horst Berger, Calbe (DE)

(73) Assignee: DOPPSTADT FAMILIENHOLDING GMBH, Velbert (DE)

( * ) Notice: Subject to any disclaimer, the term of this patent is extended or adjusted under 35 U.S.C. 154(b) by 442 days.

(21) Appl. No.: 13/810,290

(22) PCT Filed: Jul. 12, 2011

(86) PCT No.: PCT/EP2011/003478

§ 371 (c)(1),
(2), (4) Date: Jan. 15, 2013

(87) PCT Pub. No.: WO2012/007153

PCT Pub. Date: Jan. 19, 2012

(65) Prior Publication Data

US 2013/0112792 A1 May 9, 2013

(30) Foreign Application Priority Data

Jul. 15, 2010 (DE) ..... 20 2010 010 294 U

(51) Int. Cl.
*B02C 18/18* (2006.01)
*B02C 18/14* (2006.01)

(52) U.S. Cl.
CPC ..... *B02C 18/18* (2013.01); *B02C 18/145* (2013.01)

(58) Field of Classification Search
CPC .... B02C 13/095; B02C 13/2804; B02C 13/28; B02C 2/005; B02C 4/305; B02C 2/10; B02C 18/18; B02C 18/145; D21D 1/02
USPC ..... 241/293, 294, 189.1, 195
See application file for complete search history.

(56) References Cited

U.S. PATENT DOCUMENTS

| | | | | |
|---|---|---|---|---|
| 7,938,350 | B2 | 5/2011 | Doppstadt | |
| 2007/0194161 | A1* | 8/2007 | Doppstadt | B02C 18/18 241/294 |

FOREIGN PATENT DOCUMENTS

| | | |
|---|---|---|
| DE | 94 02 062 | 8/1994 |
| DE | 299 06 398 | 7/1999 |
| DE | 200 21 216 | 4/2001 |
| EP | 1 304 169 | 4/2003 |
| WO | 94/14540 | 7/1994 |

* cited by examiner

*Primary Examiner* — Mark Rosenbaum
(74) *Attorney, Agent, or Firm* — Jacobson Holman, PLLC.

(57) ABSTRACT

The invention relates to a blade carrier for comminution devices that consists of a tooth element which can be fixed on a comminution roller or the like, and at least one blade, wherein the blade can be arranged with a first form-fitting connection at the tooth element, in the tooth element a blade holder designed as recess is provided as first form-fitting connection in which the blade can be introduced at least partly, and the tooth element and the blade have a form corresponding to each other, at least at the connection side(s), wherein in the recess or in the blade holder and at the blade at least one further form-fitting connection is provided. The invention is characterized in that one part of the tooth element is designed as support element, at least one part of the further form-fitting connection is provided at a support element, and one part of the further form-fitting connection at the support element extends additionally over angled running support surfaces that are designed there.

21 Claims, 2 Drawing Sheets

BLADE CARRIER FOR COMMINUTION DEVICES

Figure 1C:
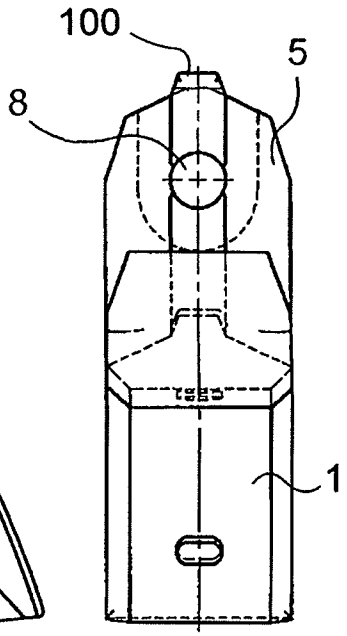

This is a national stage of PCT/EP11/003478 filed Jul. 12, 2011 and published in German, which has a priority of German no. 20 2010 010 294.4 filed Jul. 15, 2010 hereby incorporated by reference.

The invention refers to a blade carrier for comminution devices consisting of a tooth element which can be fixed on a comminution roller or the like, and at least one blade, wherein the blade can be arranged on the tooth element with a first form-fitting connection at the tooth element, wherein in the tooth element a blade holder designed as recess is provided as first form-fitting connection in which the blade can be at least partially introduced, and wherein the tooth element and the blade have a form corresponding to one another at least on the connection side(s) facing each other.

Blade elements of this type are known. They are employed in comminution devices, in particular in waste comminution devices for recycling waste or the like. It is necessary here to supply different blades for the very different comminution tasks. The form or the cutting elements of the blades differ here depending on the material to be comminuted.

The wear of the blades themselves is very high, because of the material to be comminuted, what requires a frequent change of the blades. Accordingly, the costs for operating such a comminution device are affected in particular also by the tool costs for the blades. It has turned out that the material input for the blades altogether is too high. This means that the relation of the material input or the material weight of the tooth element and the blades has to become more favorable with reference to the blades.

The scope of work for a blade exchange remains rather high so that it also appears to be necessary to present more advantageous solutions here with reference to the solutions known from the state of the art. The effort for a respective switch either in the form of new blades for the same comminution tasks or in the form of differently designed blades for other comminution tasks is high here, so that it is necessary to come to more convenient solutions here.

In the specification EP 05784053 a solution has become known that is supposed to be characterized in that for holding the blade at the tooth element a blade holder is provided configured as recess, and the recess has a first form-fitting connection, that is characterized by the configuration of the form-fitting connection itself, and that is furthermore characterized by accordingly designed recess surfaces.

Furthermore, it is known from the state of the art to provide cylinders for the use with different blades with respective blade holders, and to change the cylinders for altered comminution tasks. This modification is very complex.

Furthermore it is known to provide cylinder segments on basic cylinder bodies and to equip these with the blade carriers. Here, the respective cylinder segments have to be changed when the comminution task changes. Here also the costs are rather high for this change.

Furthermore, a milling tooth for a comminution machine is known from the specification DE 200 21216 U1 that can be fastened, at least partly, form-fitting to a milling tooth holder of a comminution machine.

In the specification G 94 02 062.0 a multi-piece comminution mallet for organic waste material is known where the cutting part is connected force-fitting via a screw or clamping connection with a holder.

In the specification EP 1304169 A 2 a comminution device for industrial waste has become known where comminution tools are provided on a comminution roller. Here also the blades are fastened to a blade part element form- and force-fitting.

In the specification DE 20 2005 009 859 U1, a previous application by the applicant, a solution has become known where the blade can be fastened form-fitting to the tooth body. The before described disadvantages of the state of the art occur here also, at least partly.

DE 299 06 398 U1 describes a milling tool where a holder carries a tool, wherein the tool can be inserted in a mount of the holder, wherein a form-fitting device is provided between mount and tool. This solution is costly to construct and complicated. The above described disadvantages also occur here.

Furthermore, in the specification WO 94/14540 an exchangeable cutting insert of a comminution disc is known as further solution of the state of the art that can be assigned to the before described categories with the described disadvantages.

None of the described solutions of the state of the art offers a modification where the ratio of tooth to tooth element is configured favorably in favor of the tooth and the blade, respectively. Furthermore, the wear of the known form-fitting connections is rather high, and the production of the form-fitting connection itself, either at the blades or the tooth holders, causes relatively high expenses.

Referring to this state of the art, it is thus a problem to suggest a blade carrier that designs the ratio of tooth element to blade more favorably in favor of the blade so that the expenses can be reduced. Furthermore, it is a problem of the invention to improve the effort for producing a blade carrier when realizing a form-fitting connection as well as the form-fitting connection itself.

The problem of the invention is solved by a blade carrier for comminution devices consisting of a tooth element which can be fixed on a comminution roller or the like, and at least one blade, wherein the blade can be arranged on the tooth element with a first form-fitting connection, wherein at the tooth element a blade holder designed as recess is provided as first form-fitting connection in which the blade can be introduced at least partly, and the tooth body and the blade have a form corresponding to one another at least on the connection side(s), wherein in the recess or in the blade holder and at the blade at least one further form-fitting connection is provided, and the blade carrier is characterized in that a part of the tooth element is configured as support element, at least a part of the further form-fitting connection is also provided at the support element, and a part of the further form-fitting connection at the support element extends additionally over support surfaces there which run angled. The support element takes over the task of supporting the blade during the use according to its purpose, and keeping the wear low. According to the invention, now the support element is guided clearly higher at a cutting line defined by the cutting edge of the blade in such a way that it is only a few millimeters away from this cutting line. This accomplishes that, first, the blade is clearly better supported during the use according to its purpose, and, secondly, at the same time, of course, also the material used for the blade itself is reduced further. It is furthermore an advantage that another part of the form-fitting connection at the support element extends over support surfaces configured there additionally which run angled. Here also this design serves for realizing two purposes, namely, on the one hand, gaining further material in favor of the blade, and, on the other hand, improving the self-centering and support of the blade at the tooth element.

The design according to the invention therefore accomplishes, on the one hand, reducing the material used for the blade by keeping the complete share at the blade for the blade carrier altogether lower than, for example, in the state of the art. Furthermore, it accomplishes that the self-centering during the use of the blades in the tooth element is made considerably easier as the further form-fitting connection performs an optimizing of the self-centering. Fastening the blade at the tooth element by means of usual fastening means is not decisive here, as by self-centering, purely theoretically, the blade does not necessarily have to be fastened. When used as intended, this is accomplished by the way of the design of the blade holder with the at least two form-fitting connections, the self-centering and fixing or clamping. It is an advantage here that at least a part of the further form-fitting connection is provided at the support element. This reduces further the material used for the knife, and also improves the centering and, in particular, a corresponding change of the knife after it is worn out or when the intended use of the comminution device changes, is clearly easier.

According to an advantageous development of the invention, the blade carrier is characterized in that the further form-fitting connection is designed in the recess at the tooth element by a tongue, and at the blade by a corresponding groove. This design has two advantages. First, it accomplishes that the self-centering or centering of the blade at the tooth element is clearly simplified and improved. Furthermore, it is also accomplished that the material share of the blade with respect to the entire blade carrier is clearly reduced, as in the preferred modification the groove extends in the knife and the tongue in the recess of the tooth element.

Of course, also the reversed solution is comprised by the invention according to which a further form-fitting connection is configured in the recess at the tooth element by a groove and at the blade by a corresponding tongue. This design, however, has a slightly larger material share of the blade with respect to the tooth element.

As already mentioned, the further form-fitting connection improves the self-centering considerably. The further form-fitting connection, for example in the shape of a tongue-and-groove embodiment, extends here over the entire blade holder, so that the self-centering can be performed in a simple way or it happens on its own.

Accordingly, an advantageous development of the invention is characterized in that the support element extends closely to a cutting line defined by the cutting edge of the blade such that it is only a few millimeters away from this cutting line.

According to a development of the invention, the support element is provided such that it extends first in the recess almost vertically, as already mentioned, until rather closely to the cutting line of the blade defined by the cutting edge. An angling is performed there in almost horizontal extension or almost rectangular.

Another aspect of the invention is given by the fact that groove and tongue extend at least over the side of the support element pointing in cutting direction and over the corresponding sides or surfaces of the blade, that are in mounted condition part of it.

Thus a convenient design of the two components according to the invention is influenced positively, namely reduction of the material share with respect to the overall weight of the blade carrier, and, on the other hand, also improving of the centering and the connected more convenient change or easy change of the blades after wear or when a blade change is required.

According to the invention, the blades are arranged releasable fixed at the tooth element. The releasable fixed connection between blade and tooth element is realized, for example, by a screw connection, which will be described later on.

The invention is characterized in that the blade holder is arranged at the end of the tooth element that is in front in cutting direction. This is an advantage, as thus at the same time several favorable effects are accomplished. Thus, it is possible to realize an appropriate free cut that can be performed, for example, through the way of design of the blade. Furthermore, of course, the arrangement of the blade in the rotating or cutting direction is always an advantage. The type of the blade itself can then be designed in a special way. The cutting edge can be configured with different angles or appropriate concave or convex designs of the blades in cutting direction can be carried out. The invention is here not restricted to a particular design and rather universal.

The invention is also characterized in that the recess has a nose at the end in front seen in cutting direction, wherein preferably this nose in the recess is designed cylinder-like. The recess as first form-fitting connection is, of course, configured correspondingly such that the blade is self-centered even more effectively and fastened. This design allows that the blade is supported at the nose and is centered and supported accordingly during the cutting operation not only at the support element but also at the nose. This reduces wear and, in particular, also the frequently mentioned use of material of the blade.

Seen from the side, the recess has the shape of a J. This forms, as already mentioned, the first form-fitting connection.

It is also an advantage, when in the recess preferably outwards sloping or wedge-like or conically outwards running recess surfaces are provided. These effect a further improvement of the centering and the hold of the blade in the recess. Of course, for this purpose, at the blade corresponding surfaces have to be provided.

According to the invention, it has also been found to be an advantage if at the side of the support element facing the blade outward sloping or wedge-like or conically outward running support surfaces are provided. Thus, also at the support element not only in the recess or in the bottom part of the recess appropriate support surfaces are provided that offer the analogous advantages as already described.

If there are foreign particles in the material to be comminuted, not only the blades but also the tooth element(s) might be damaged. Accordingly, it is an advantage when also the tooth element is fastened to the comminution roller such that it can be exchanged without further ado. It has been proved advantageously that the tooth element can be fastened to the comminution roller by welding. Here, for example, at the sides of the side of the tooth element facing the roller, welding seams are drawn that can be removed again during an exchange by grinding without any problems.

In order to improve the exchange of the tooth elements altogether, it is convenient when at the underside or at the side facing the comminution roller a centering device is provided for centering the roller. Thus, during exchange only the tooth element has to be aligned to the roller with the centering device, what can be done quite easily by sliding on, and then fastening can be carried out, for example by drawing the already described welding seams.

According to the invention it is provided here that the centering device of the tooth element is designed as centering catch interacting correspondingly and form-fitting with a centering bore hole arranged on the comminution roller or an appropriate centering groove. It is an advantage of such a configuration that this modification of the invention accomplishes that the tooth elements according to the invention can also be employed in older comminution devices, where usually the tooth element was provided with a tongue to center it at the roller. Rollers of this type can now be provided also with tooth elements according to the invention. Here just the centering catches are inserted in the tongue, they only have to be orientated according to the desired position on the roller in rotating direction.

As already mentioned, the blades are fastened to the tooth element. For this purpose fastening means are provided by means of which they can be fastened to each other releasable fixed. The fastening means is here, for example, a screw connection through which bore holes run in the tooth element and in the blade. The bore holes, as it can be seen in the drawings, are, of course, provided correspondingly to each other, so that the screw is located, for example, with its screw head in the blade, and is screwed there at the backside with reference to the cutting direction of the tooth element, for example, at the support element by means of a nut.

According to the invention, it is an advantage when the tooth element and/or the blade are made from metal, preferably as cast components. This is a comparatively economic way of production for the elements of the blade carrier that allows an economic manufacture.

The blade carrier according to the invention is furthermore characterized in that the side faces of the tooth element taper off upward, taper or run in the direction of the external radius.

Furthermore, it is an advantage when the external radius of the tooth element at its side opposite the blade holder intersects the external radius of the comminution roller. This accomplishes that the tooth element can be designed altogether thinner. It tapers accordingly in the opposite direction of the cutting direction. The support for the blade altogether is not affected thereby.

As already mentioned above, it is, according to the invention, also possible to configure the blade holder such that the blade can have different shapes. Thus, it is, according to the invention, possible, for example, to employ triangular, rectangular, semi-circle or polygonal blades, and to fasten them in the blade holder. The blades are here designed each time according to the shape of the blade holder at the side facing the blade holder, as already described, and they have different shapes only at their cutting elements or edges.

Accordingly, the blade has at least one cutting edge designed concavely preferably at the side facing the cutting direction. Of course, this improves the cutting effect. However, it is also possible to provide blades with a configuration where the blade is wider than the tooth element such that the result is a free cut.

Of course, the blade is designed at the sides facing the tooth element correspondingly to the recess surfaces or support surfaces of the tooth element, and has accordingly also outward sloping or angled surfaces. These surfaces are provided in addition to the tongue-and-groove configuration, and serve for the more convenient support and, in particular, for improving the self-centering.

Here, sides of the blade orientated towards the tooth element and downwards to the recesses are configured as recess surfaces, wherein the inclination of these surfaces corresponds with the one of the recess surfaces. Furthermore, two sides of the blade facing the tooth element are designed as counter support surfaces, and correspond here with the support surfaces of the support element.

Furthermore, it is provided, that at least two sides of the support element facing the support surfaces are designed as counter top part surfaces, and have also the already mentioned corresponding inclination. Now, more components according to the invention are decisive for, first, the clearly more convenient design of the centering or self-centering of the blade in the tooth element altogether than in the solutions of the state of the art. Secondly, this design accomplishes that just by combining all of the described characteristics the material share of the blade to the material share of the tooth element can be designed clearly more favorably than in the solutions of the state of the art.

According to another embodiment, the blade carrier according to the invention is characterized in that the blade has a put-on cutting edge formed preferably of hard metal. It is furthermore an advantage when the size of the blade can be adapted because of different comminution tasks. In the simplest configuration, this is performed, of course, by exchanging the blades where, for example, the size of the blade then is adapted to the respective comminution task. This exchange of blades can be carried out essentially faster because of the solution according to the invention than in the known solutions of the state of the art. Accordingly, the invention has also in this respect essential advantages compared with the solutions known so far.

Furthermore, it is also provided, according to the invention, that the blade has a hardened area at the edges pointing in cutting direction, preferably at both side edges. It is an advantage here when the hardened area(s) is/are produced by hardfacing or welding-on.

Of course, the invention also refers to a comminution device with at least one blade carrier, as described before.

It is an advantage here when a multitude of blade carriers is arranged on a comminution roller, in particular staggered. It has here turned out to be in particular convenient when the blade carriers, seen from the side, extend about spiral-like across the comminution roller.

Figure 1B:
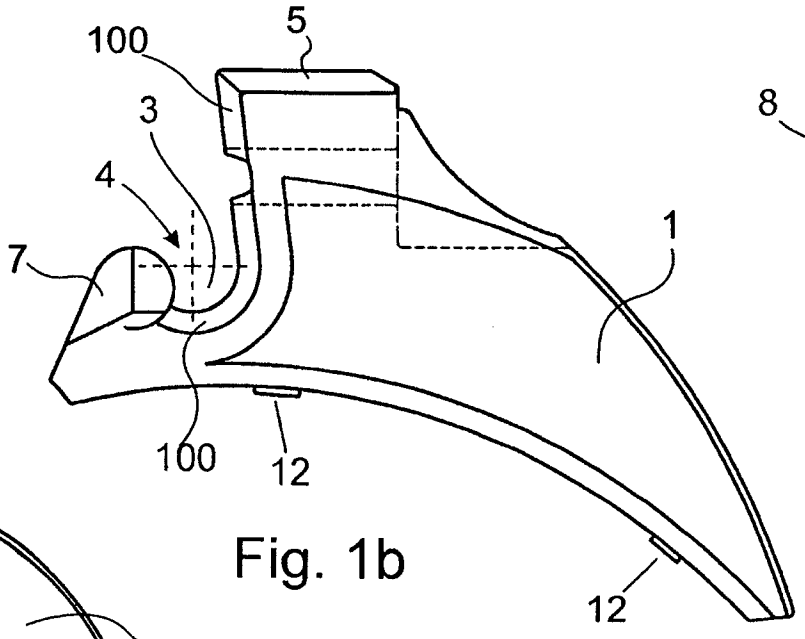
Figure 1D:
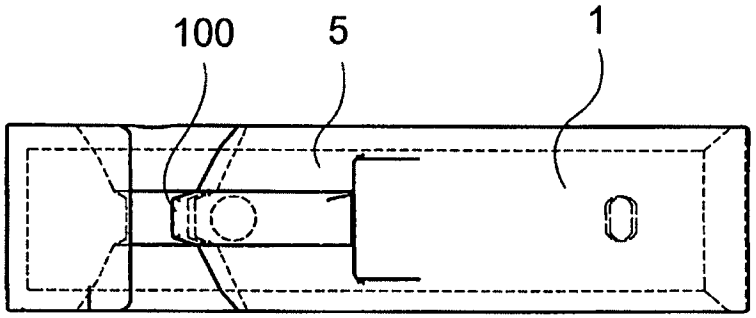
Figure 1A:
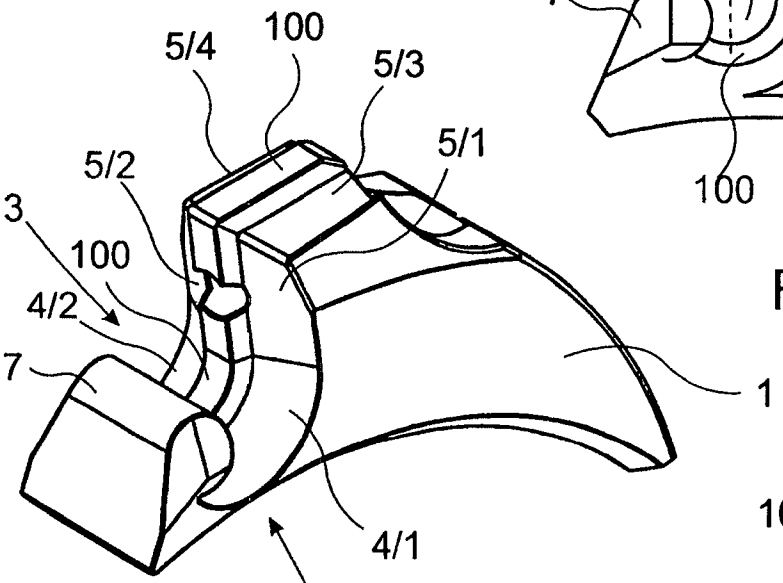
Figure 2C:
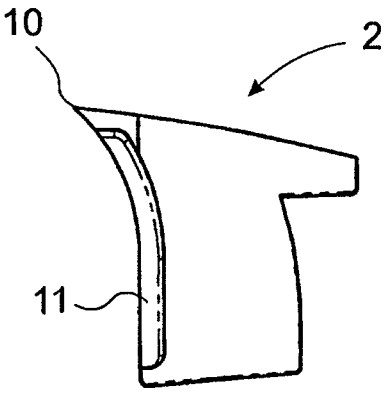
Figure 2B:
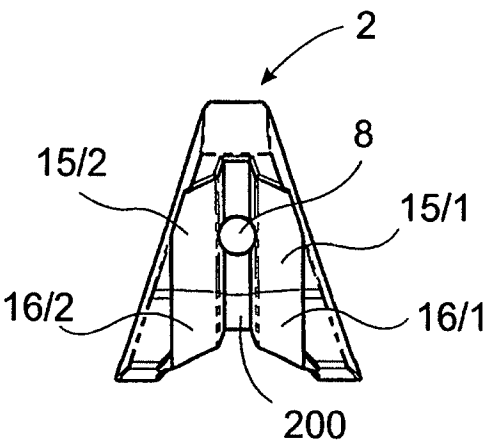
Figure 2A:
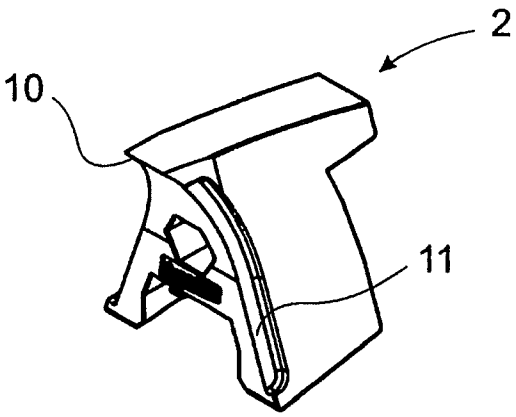
Figure 2E:
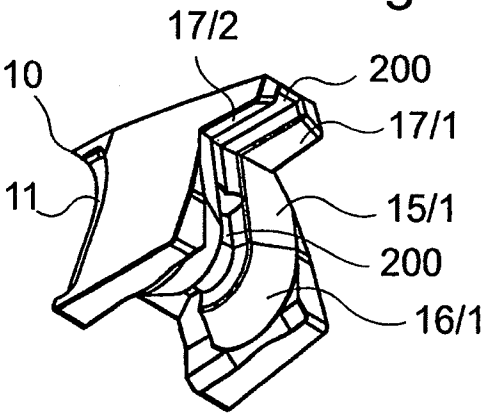
Figure 2D:
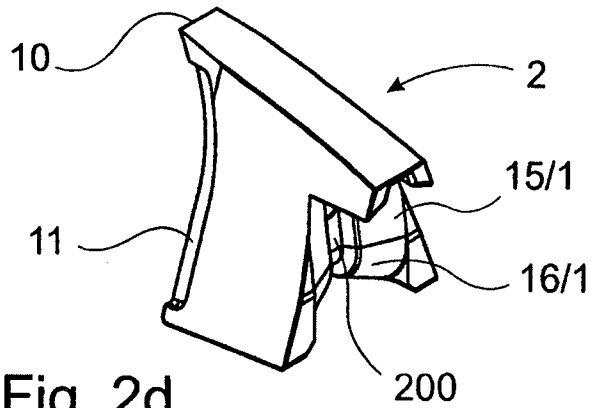

In the following, the invention will be described with reference to the embodiments:

In the drawings:

FIGS. 1 *a* to 1 *d* different views of the tool element for the blade carrier according to the invention, and FIGS. 2 *a* to 2 *e* different views of the configuration of the blade in a first embodiment according to the invention.

FIGS. 1 *a* to 1 *d* show different views of the tooth element 1 according to the invention. FIG. 1 *a* shows here a three-dimensional view, FIG. 1 *b* a side view, FIG. 1 *c* a view from the back, and FIG. 1 *d* a view from the top. In all figures, identical characteristics are referred to with identical reference numbers so that a multiple presentation of the reference numbers will not be performed. The description of the configuration of the embodiment of the tooth element 1 to the blade carriers according to the invention is carried out essentially by means of FIGS. 1 *a* and 1 *b*. As it can be seen in FIG. 1 *a*, at the tooth element 1 *a* blade holder 3 is indicated schematically by an arrow. The blade holder is also schematically indicated by reference number 4. This can be seen well in FIG. 1 *b*. There the blade holder 4 has, seen from the side, the shape of a "J".

The blade holder 4 is limited here by a nose 7 located at the front end or in the direction of cutting. This nose 7 is designed preferably roller-like. In the recess 3 or in the blade holder 4 another form-fitting connection is defined, and this is, in the embodiment according to the invention, by a tongue 100. This tongue 100 extends in the recess 3 or in the blade holder 4 from the nose 7 across the bottom part of the recess 3, and extends further to a support element 5. Here, it can be seen in particular in FIG. 1 *a* that the tongue 100 extends also across angled extending support surfaces 5/3, 5/4. This tongue interacts with a groove 200 located at the blade 2 (see FIG. 2) for a further form-fitting connection that offers an excellent self-centering and, in particular, also provides that the material used at the blade can be reduced.

In the blade holder 3, even other recess surfaces 4/1, 4/2 are provided extending about up to the end of the radius of the recess 3. These recess surfaces 4/1, 4/2 are designed tapering off outwards or wedge-like or conically. Here, in contrast to the previous solutions of the state of the art, the angle of these surfaces has been changed, namely enhanced up to about 25°. This improves, firstly, the durability, secondly, it improves the form-fitting, and thirdly, the self-centering is more convenient, and fourthly, a more convenient fastening at the tooth element 1 for the blade 2 is accomplished. The support element 5 is, compared with the solutions known in the state of the art, drawn clearly higher, i.e. it is located closer to the turning circle defined by the tip of the blade or the upper cutting edge of the blade 2 (see FIG. 2). The distance from this turning circle or from the cutting line is different, depending on the embodiment of the blades 2. Accordingly, it can be between 20 and 50 millimeters, in some embodiments even up to 80 millimeters.

The configuration or guide of the tongue 100 over the support element 5 or its support surfaces 5/3, 5/4 offer also another form-fitting connection that also leads to an improvement of the centering effect altogether.

Of course, it is also provided here that these support surfaces also extend outwards, sloping. For fastening and securing, respectively, of the blade 2, not shown in FIGS. 1 *a* to 1 *d*, a bore hole 8 is provided through which in the final position, that means when the blade 2 is put in, a not-shown screw is guided. This is regularly guided such that its head is arranged covered in the blade 2, and clamped on the side opposite the cutting direction with a nut, preferably by means of safety rings or the like.

On the side of the tooth element 1, facing the roller in mounted position, also centering catches or centering nabs 12 are configured interacting correspondingly and/or form-fitting with a not-shown centering bore hole or centering groove on the roller. This serves for positioning the tooth element 1 simply and safely at the desired position on the roller, and then fastening the tooth element as usual. This can be performed, for example, by welding the tooth element 1 to the comminution roller.

FIGS. 2*a* to 2*e* show different views of an embodiment of a blade 2 according to the invention. Blade 2 has here a cutting edge 10 on the side pointing in cutting direction. It can be seen clearly that the sides and edges of the blade in cutting direction have a hardened area 11. This is provided preferably on both sides in cutting direction of the blade 2. These hardened areas 11 can be produced, for example, by hardfacing or welding on. The cutting edge 10 can be formed to the blade 2. However, it can also be a put-on cutting edge 10. A cutting edge 10 of this type is then made preferably of hard metal.

FIG. 2 *b* show a view from the back. The counter support surfaces 15/1 and 15/2 are shown here. Furthermore, the recess surfaces 16/1 and 16/2 are indicated that are provided in mounted position pointing in the direction of the tooth element 1 downwards. These correspond, for example, with the recess surfaces 4/1 and 4/2 of the tooth element 1. Furthermore, a bore hole 8 is provided also in the blade 2. The way of function has already been described before.

Of course, in the blade a groove 200 is designed as corresponding counter piece to the tongue 100 in the tooth element 1. It extends, as it can be seen in particular in FIG. 2 *e*, on the side opposite the cutting direction over the entire blade element of the blade 2. Furthermore, in FIG. 2 *e* the counter top part surfaces 17/1 and 17/2 can be seen, that interact with the support surfaces 5/3 and 5/4 of the tooth element 1. The drawings show here only one embodiment of a blade 2. In all blades 2 that can be inserted in the blade carriers according to the invention, the sides facing the tooth element 1 have to be provided analogously to the embodiment shown in FIGS. 2 *a* to 2 *e*. On the front side or upwards, of course, depending on the respective different comminution tasks, different shapes of blade elements can be provided.

It has to be mentioned that it is provided in the embodiment according to FIG. 2 to provide the side pointing in cutting direction with the cutting edge 10 of the blade 2 with reference to the cutting edge 10 extending concavely.

The invention has been described before by means of an example. The claims filed now and to be filed later on are attempts for formulating without prejudice for a further protection.

The references in the sub-claims refer to further embodiment of the subject matter of the main claim by means of the characteristics of the respective sub-claim. These are, however, not to be understood as a waiver of an independent, subjective protection for the characteristics of the referred sub-claims.

Characteristics, only disclosed in the description so far, may be claimed, in the course of proceedings, as being of inventive relevance, for example to distinguish from the state of the art.

The invention claimed is:

1. A blade assembly for comminution devices, consisting of a comminution roller;

a tooth element that is fixed on the comminution roller; and at least one blade;

wherein the blade is arranged with a first form-fitting connection at the tooth element, a blade holder configured as recess is provided in the tooth element as the first form-fitting connection in which the blade is at least partly introduced, and the tooth element and the blade have at least at connection sides a shape corresponding to each other, wherein in the recess or in the blade holder and at the blade at least a second form-fitting connection is provided, wherein a part of the tooth element is a support element, at least a part of a third form-fitting connection is provided at the support element, and the part of the third form-fitting connection at the support element on the support element extends additionally over support surfaces at an angle; and wherein the second form-fitting connection in the recess at the tooth element is formed by a tongue and at the blade by a correspondingly arranged groove or the second form-fitting connection in the recess at the tooth element is formed by a groove and at the blade by a correspondingly arranged tongue.

2. The blade assembly according to claim 1, wherein a self-centering device is provided by the third form-fitting connection or the support element extends closely to a cutting line defined by a cutting edge or at an external turning circle of the blade in such a way that the supporting element is only about 20 to 50 mm away from this cutting line.

3. The blade assembly according to claim 1, wherein the second form-fitting connection in the recess at the tooth element is formed by the tongue and at the blade by the correspondingly arranged groove is provided and the groove and the tongue extend at least over the side of the support element facing in cutting direction, and over the corresponding sides or surfaces of the blade that are part of the blade in mounted condition.

4. The blade assembly according to claim 1, wherein the blade is arranged releasable fixed at the tooth element or the blade holder is arranged at the end of the tooth element that is in front in cutting direction or the recess has a nose at the end in front seen in cutting direction, or the nose of the recess is a roller.

5. The blade assembly according to claim 1, wherein the recess has, seen from the side, the shape of a "J" forming the first form-fitting connection or in the recess outwards sloping or wedge-shape or conically outwards extending recess surfaces are provided.

6. The blade assembly according to claim 1, wherein at a side of the support element facing the blade outwards sloping or wedge-shape or conically outwards extending support surfaces are provided or the tooth element is fastened on or at the comminution roller of the comminution device by welding or the tooth element has at the tooth element's underside or the side facing the comminution roller a centering device for centering the roller.

7. The blade assembly according to claim 1, wherein a centering device of the tooth element is centering catch or centering naps interacting with a centering bore hole provided on the comminution roller or a centering groove correspondingly and form-fitting or tooth element and blade have a fastening part by means of which the tooth element and the blade are connected to each other releasable fixed, and/or the fastening part is at least one screw connection guided through bore holes in the tooth element and in the blade.

8. The blade assembly according to claim 1, wherein the tooth element or the blade are made from metal or the side faces of the tooth element taper off diagonally upward, taper or taper off to an external radius.

9. The blade assembly according to claim 8, wherein the tooth element or the blade is cast components.

10. The blade assembly according to claim 1, wherein an external radius of the tooth element intersects with an external radius of the comminution roller at the tooth elements side that is opposite to the blade holder.

11. The blade assembly according to claim 1, wherein the blade holder is configured such that the blade is introduced or fastened with different shapes of the blade selected from a group consisting of triangular, rectangular, and polygonal blades.

12. The blade assembly according to claim 1, wherein the blade is formed as a tooth, has a cutting edge, and is formed concavely on the side pointing in cutting direction or the blade is configured wider than the tooth element such that the result is a free cut.

13. The blade assembly according to claim 1, wherein the blade is on the sides pointing to the tooth element correspondingly to surfaces of the recess and the support surfaces sloping outwards from or angled with the supporting element.

14. The blade assembly according to claim 1, wherein two sides of the blade pointing at the tooth element and orientated downward to the recess have corresponding surfaces, and the inclination of the corresponding surfaces corresponds with the recess.

15. The blade assembly according to claim 1, wherein two sides of the blade pointing at the tooth element have corresponding support surfaces, and the inclination of the corresponding support surfaces corresponds with the one of the support surfaces of the tooth element.

16. The blade assembly according to claim 1, wherein two of the sides pointing at the support surfaces are corresponding top part surfaces and have a corresponding inclination.

17. The blade assembly according to claim 1, wherein the blade has a fitted cutting edge or the size of the blade is adapted basing on different comminution tasks.

18. The blade assembly according to claim 17, wherein the cutting edge is formed of hard metal.

19. The blade assembly according to claim 1, wherein the blade has at edges pointing in cutting direction at least one hardened area, and/or the at least one hardened area has been created by hard facing or welding-on.

20. A comminution device with at least one blade assembly for comminution devices, consisting of a comminution roller;

a tooth element that is fixed on the comminution roller; and at least one blade;

wherein the blade is arranged with a first form-fitting connection at the tooth element, a blade holder configured as recess is provided in the tooth element as first form-fitting connection in which the blade is at least partly introduced, and the tooth element and the blade have at least at connection sides a shape corresponding to each other, wherein in the recess or in the blade holder and at the blade at least a second form-fitting connection is provided, wherein a part of the tooth element is a support element, at least a part of a third form-fitting connection is provided at the support element, and the part of the third form-fitting connection at the support element extends additionally over support surfaces on the support element at an angle; and wherein the second form-fitting connection in the recess at the tooth element is formed by a tongue and at the blade by a correspondingly arranged groove or the second form-fitting connection in the recess at the tooth element is formed by a groove and at the blade by a correspondingly arranged tongue.

21. The comminution device according to claim 20, wherein a multitude of blade assemblies are arranged on a comminution roller.

* * * * *